US006070678A

United States Patent [19]

Pascale

[11] Patent Number: 6,070,678

[45] Date of Patent: Jun. 6, 2000

[54] BIT RETENTION SYSTEM

[75] Inventor: Jack H. Pascale, Greartown, Pa.

[73] Assignee: Numa Tool Company, Thompson, Conn.

[21] Appl. No.: 09/071,229

[22] Filed: May 1, 1998

[51] Int. Cl.[7] ..... E21B 10/36

[52] U.S. Cl. ..... 175/300; 175/414; 173/132

[58] Field of Search ..... 175/296, 258, 175/300, 414, 189; 173/133, 132

[56] References Cited

U.S. PATENT DOCUMENTS

| | | | |
|---|---|---|---|
| 2,252,912 | 8/1941 | Armentrout . | |
| 2,949,909 | 8/1960 | Macchioni et al. . | |
| 3,735,820 | 5/1973 | Curington . | |
| 4,819,746 | 4/1989 | Brown et al. | 175/296 |
| 4,903,785 | 2/1990 | Odoni et al. | 175/293 |
| 4,962,822 | 10/1990 | Pascale . | |
| 5,065,827 | 11/1991 | Meyers . | |
| 5,390,749 | 2/1995 | Lyon | 175/296 |
| 5,562,170 | 10/1996 | Wolfer et al. | 175/296 |
| 5,699,867 | 12/1997 | Jones | 175/296 |

FOREIGN PATENT DOCUMENTS

| | | |
|---|---|---|
| 0 286 373 A2 | 4/1988 | European Pat. Off. . |
| WO 87/04487 | 7/1987 | WIPO . |

*Primary Examiner*—Frank Tsay
*Attorney, Agent, or Firm*—Alix, Yale & Ristas, LLP

[57] ABSTRACT

A substantially tubular retainer member is provided, having a bore of substantially uniform internal diameter which can slip over the retention shoulder of the percussion bit, whether that shoulder is solid or threaded. Pins are then driven through holes in the retainer, under the retention shoulder. The pins retain the head of the bit in the event of bit breakage.

17 Claims, 4 Drawing Sheets

BIT RETENTION SYSTEM

BACKGROUND OF THE INVENTION

This invention relates generally to earth boring percussion bits. More particularly, the invention relates to retention systems for ensuring that even when broken during use, the percussion bit remains connected to the drill string.

U.S. Pat. No. 5,065,827 discloses a conventional hammer and percussion bit assembly having a percussion bit retention system. The percussion bit retention system includes a retainer which is mounted on the drive sub of the percussion bit assembly. The retainer includes a lower section having an inner chamber and a thread-shaped, inwardly extending projection. The bottom portion of the percussion bit includes a head section, a threaded section and a recess disposed intermediate the head section and the threaded section. The percussion bit is installed by inserting the upper portion of the percussion bit into the retainer until the threaded section of the lower portion abuts the thread-shaped projection of the retainer. The projection is brought into threaded engagement with the threaded section of the retainer and the retainer is rotated until the projection passes completely through the threaded section of the retainer and enters the chamber. If the percussion bit breaks in the shaft portion above the bottom portion of the percussion bit, the projection will be captured within the chamber by the threaded section of the retainer.

The threaded section of such retainers may become fouled during drilling operations, making removal of the percussion bit difficult. Bits may be difficult to install due to corrosion and wear induced degradation of the threaded section of the retainer.

SUMMARY OF THE INVENTION

With the present invention, a novel percussion bit assembly, and associated novel bit retainer member and method of assembling the bit retainer to a percussion bit drill string, can be simply achieved without the requirement for rotating the bit relative to the retainer, and without the risk of thread fouling.

In accordance with the invention, a substantially tubular retainer member is provided, having a bore of substantially uniform internal diameter which can slip over the retention shoulder of the percussion bit, whether that shoulder is solid or threaded. Pins are then driven through holes in the retainer, under the retention shoulder. The pins retain the head of the bit in the event of bit breakage.

Preferably, at least two pins are provided, each extending through and supported by a pair of spaced apart holes through the retainer wall. The pins are preferably oriented in parallel. The shank of the percussion bit extends upwardly into the retainer such that an outwardly extending shoulder adjacent the head of the percussion bit is positioned above the pins. The span between the pins is smaller than the outside diameter of the shoulder. Consequently, the shank of the percussion bit is held within the retainer if the shank is severed.

In one embodiment, the outside diameter of the lower portion of the chuck member is greater than the outside diameter of the upper portion of the chuck member, to define a shoulder. The retainer may have an upper, interiorly projecting lip clamped between the lower end of the housing and the shoulder of the chuck member.

In another embodiment, the chuck has opposed exterior grooves for receiving locking pins passing through the upper portion of the retainer.

It is thus an object of the invention to provide a new and improved retention system and assembly method for a percussion bit assembly.

It is also an object of the invention to provide a retention system and method for a percussion bit assembly that does not require threaded engagement between the percussion bit and the other components of the retention system.

A significant advantage of the present invention, is that the retainer system can be backfit without threading makeup, into conventional percussion bit assemblies, such as disclosed in U.S. Pat. No. 5,065,827.

Other objects and advantages of the invention will become apparent from the drawings and specification.

BRIEF DESCRIPTION OF THE DRAWINGS

The present invention may be better understood and its numerous objects and advantages will become apparent to those skilled in the art by reference to the accompanying drawing in which.

DETAILED DESCRIPTION OF THE PREFERRED EMBODIMENT

Figure 1:
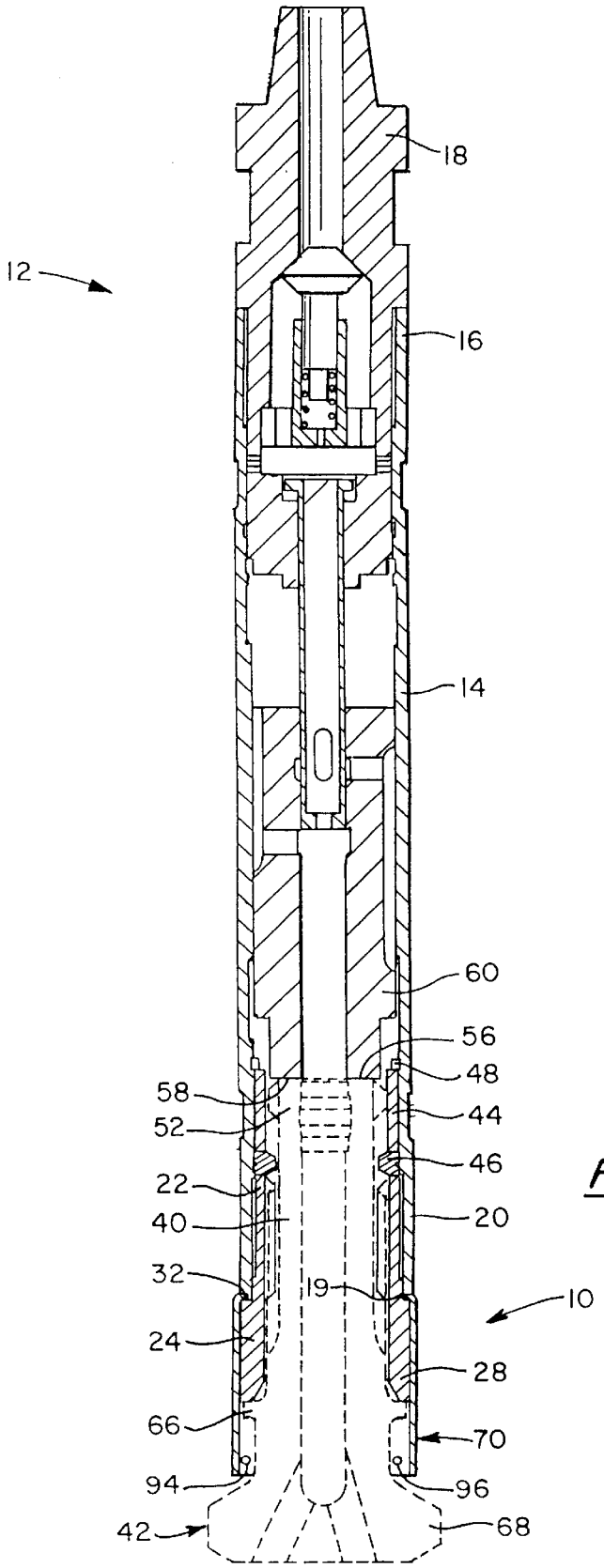
FIG. 1 is an elevation view, partly in section and partly in phantom, of a hammer-percussion bit assembly in the drilling mode of operation, having a percussion bit retention system in accordance with a first embodiment of the invention.
Figure 3:
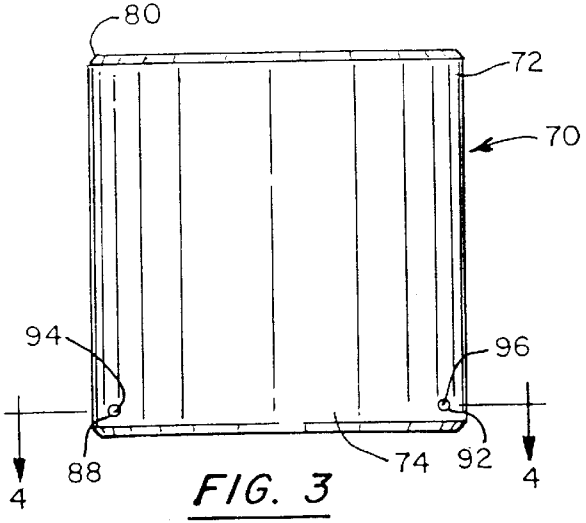
FIG. 3 is an elevation view of the bit retainer element of the embodiment of FIGS. 1 and 2.

With reference to the drawings wherein like numerals represent like parts throughout the several figures, a hammer-percussion bit assembly 12 with bit retention system 10 according to a first embodiment, is shown in FIGS. 1–4. The percussion bit assembly 12 comprises a hammer housing 14 threadably connected at its upper end portion 16 to a drill string mounting member 18. An opening 19 in the lower end 20 of the housing 14 receives the upper portion 22 of tubular chuck member 24 and is threadably connected thereto. The outside diameter 26 of the lower portion 28 of the chuck member 24 is greater than the outside diameter 30 of the upper portion 22 of the chuck member 24, to define a shoulder 32. The chuck member 24 has a plurality of longitudinally extending splines 34 located on the interior surface 36 for matingly receiving splines 38 located on the shank 40 of the percussion bit 42, to selectively rotate or permit relative axial displacement of the bit 42.

A lock cylinder 44 and a split lock ring 46 are positioned within the interior of the housing 14. The upper end of the lock cylinder 44 abuts a shoulder ring 48 fixedly mounted within the housing 14 and the lower end of the lock cylinder 44 and the upper end of the lock ring 46 abut each other. When the chuck member 24 is installed, the upper end 50 of the chuck member 24 abuts the lower end of the lock ring 46 to hold the lock ring 46 and lock cylinder 44 in place. The upper portion 52 of the percussion bit shank 40 is disposed within the lock ring 46 and lock cylinder 44 such that an upper radially extending shoulder 54 on the upper portion 52 is positioned within the lock cylinder 44 and above the lock ring 46. The inside diameters of the lock cylinder 44 and the lock ring 46 and the outside diameter of the upper shoulder 54 are selected such that the upper shoulder 54 is free to move up and down within the lock cylinder 44 and is captured by the lock ring 46.

Figure 2:
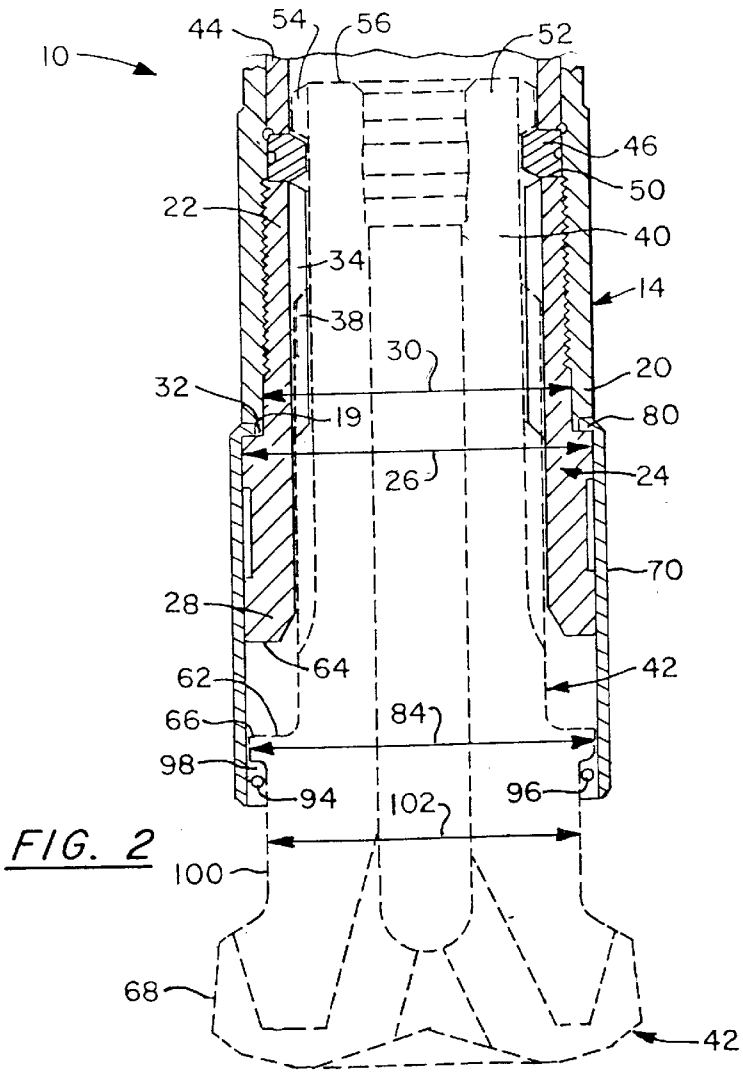
FIG. 2 is an enlarged view, partly in section and partly in phantom, of the lower end portion of the hammer-percussion bit assembly of FIG. 1, in the withdrawal mode of operation.

The upper shoulder 54 has a plurality of vertically extending grooves (not shown) that correspond to the splines 34 on the chuck member 24. The upper portion 52 of the percussion bit shank 40 also includes an upper bearing surface 56. The percussion bit shank 40 has a lower bearing surface 62 adapted for bearing against the lower surface 64 of the chuck member 24. The bottom surface 58 of the hammer 60 impacts against the upper bearing surface 56 to impart a percussive force to the bit 42. Alternatively, the percussive force may be transmitted through the lower surface 64 of the chuck member 24 to the lower bearing surface 62 of the bit 42. A lower radially extending shoulder 66, preferably an annular rim, is disposed below the lower bearing 62 surface and adjacent to the head 68 at the lower end of the percussion bit 42. As shown in FIG. 2, the lower bearing surface 62 may define the upper face of the lower shoulder 66.

A percentage of all percussion bits shanks 40 fail due to cyclic fatigue by fracturing below the lock ring 46 and above the bit head 68. When this occurs during the drilling operation, the lower section of the percussion bit is left at the bottom of the hole, requiring a costly and cumbersome fishing operation.

The percussion bit retention system 10 of the subject invention employs a substantially cylindrical (tubular) retainer member 70 having upper and lower ends 72,74 and interior and exterior surfaces 76,78. The interior surface is disposed around the lower portion 28 of the chuck member 24 and the shoulder 66 of the bit. In the embodiment illustrated in FIGS. 1–4, the upper end 72 is formed as a lip 80, preferably annular, which extends radially inward toward the axis 82 of the retainer member such that the upper lip defines upper and lower bearing surfaces, which are clamped between the housing lower end 20 and the shoulder 32 of the chuck member, in a manner substantially similar to that shown in U.S. Pat. No. 5,065,827. A longitudinal channel is defined between the upper lip and the lower end of the retainer, having a length selected to receive the lower portion 28 of the chuck member 24 and to allow free vertical movement of the lower shoulder 66 of the percussion bit 42. The inside diameter of the retainer below upper lip 80 is preferably uniform and slightly larger than the outside diameter 84 of the lower shoulder 66.

The inner surface 76 of the lower end 74 of the retainer faces the bit below the shoulder 66 on the bit shank 100. At the elevation of this inner surface, a first pair of holes 86,88 register in a first straight line from one location to another location through the exterior 78 of the retainer, and a second pair of holes 90,92 register in a second straight line between a different two locations through the exterior of the retainer, with the second straight line being parallel to the first straight line. Pin means, preferably in the form of straight, rigid rods 94,96, are insertable through the exterior surface of the lower end of the retainer, through each pair of holes, into the space 98 between the retainer and the bit.

Figure 4:
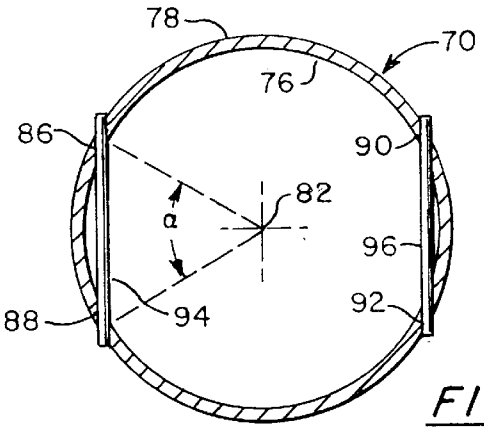
FIG. 4 is a cross section taken along line 4—4 of FIG. 3.

As shown in FIG. 4, each end of a given rod 94,96 is cradled by the concave surface of the portion of the retainer wall which defines the holes. Accordingly, each rod is supported as a simple beam, oriented transversely to the retainer radius. Each beam functions as a ledge situated in the space 98 between the retainer 70 and the bit shank 100.

Preferably, the ledges are opposed to each other on either side of the retainer center line 82, with the distance between the ledges being smaller than the outside diameter 84 of the bit shoulder 66 situated above the ledges. Therefore, in the event of breakage of the bit shank above the bit shoulder, the shoulder is retained between the lower end of the chuck member and the ledges.

In a typical implementation of the invention, the retainer member 70 is substantially tubular, with a one quarter inch thick wall, and an inner diameter of approximately 7¼ inches. The portion 100 of the bit shank between the shoulder and the head, has a substantially uniform outer diameter 102 of about 6½ inches. Therefore, when the bit is coaxially centered within the retainer, a diametral clearance of approximately ¾ inch is provided, i.e., a radial clearance of approximately ⅜ inch. In such embodiment, each pin 94,96 can be a ¼ inch thick rod, insertable through ¼ inch holes in the retainer wall. The holes are preferably oriented transversely to the retainer radius. In this configuration, the angular span a from the end of a rod 94 at one hole location 86 to the center of the rod at the other hole location 88 of a given pair (at the exterior of the retainer), would be approximately 60°. Depending on the outside diameter of the bit shank, the inside diameter of the retainer, and the relative size of the space between these members, the size and length of rod which can be accommodated therebetween, can vary somewhat. The angular span $\alpha$ between the rod centers at the ends of the rod (which as a practical matter is equivalent to the angular span of the hole centers at the exterior of the retainer), would in practical applications be less than about 90°, and preferably in the range of 50–70°.

Those practitioners in this field will recognize that the percussion bit system according to the invention, can be made up in the same sequence as described in U.S. Pat. No. 5,065,827, but with even greater simplicity. Once the bit 42 is received and secured within the housing 14 and the retainer 70 has been secured between the housing and the shoulder 32 on the chuck 24, the operator simply assures that the bit shoulder 66 is above the hole locations at the lower end 74 of the retainer, then inserts the pins in the holes, resulting in the configuration best shown in FIG. 2.

Thus, according to the method of the invention, a percussion bit assembly is formed by securing a bit for longitudinal movement within a housing, and securing a substantially tubular retainer member in fixed relation to the housing so that the retainer member surrounds and extends below an outwardly projecting shoulder formed on the bit. Pin means are then inserted through the exterior surface of the retainer at locations below the bit shoulder, such that the bit can freely move axially upwardly relative the pins, but is restricted from moving downwardly beyond the pins, because the pins serve as ledges or stop surfaces to engage the shoulders on the bit.

It should be appreciated that the cross-sectional shape of the pins and/or access holes, and the choice of materials therefore, are a matter of design optimization within the skill of the ordinary practitioner.

Figure 6:
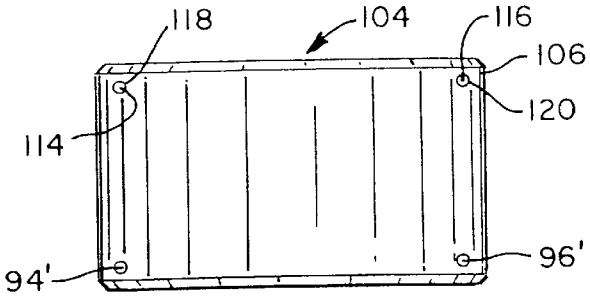
FIG. 6 is an elevation view of the bit retainer element of the embodiment of FIGS. 5.
Figure 5:
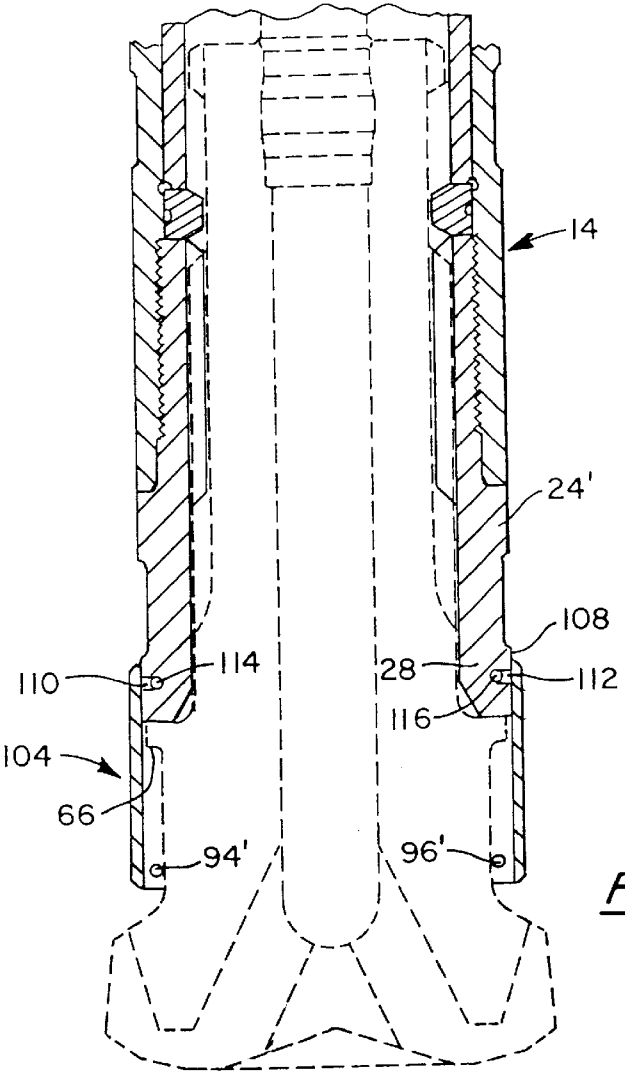
FIG. 5 is an enlarged view, partly in section, of the lower end portion of the hammer-percussion bit assembly according to a second embodiment of the invention.

FIGS. 5 and 6 show a second embodiment 104 of the invention, having a significantly shorter (in the axial direction) retainer, which is attached at its upper end 106 to the chuck 28 with the same type of pinning arrangement as described above with respect to retention of the bit head at the lower ends of the retainer. The exterior surface 108 of the lower portion 28 of the chuck is formed with groove profiles 110,112, preferably two distinct grooves spaced in 180° opposition to each other, for receiving respective pins 114, 116 inserted through a respective pair of access openings 118,120 near the upper end 106 of the retainer 104. Because the pins in this embodiment pass through grooves, rather than merely engaging an undercut, the retainer cannot rotate in relationship to the chuck. It can be appreciated that in this embodiment, the retainer is supported entirely by the lower portion of the chuck 24', without the need for capture or locking by the lower end of the housing 14. For this reason, the retainer can be significantly shorter, and therefore requires less material and handling cost, than the embodiment illustrated in FIGS. 1–3. In all other respects, in particular the relationship of the pins 94',96' in the lower end of the retainer to the confronting bit shank and bit shoulder, the embodiment of FIGS. 5 and 6 is similar to that shown in FIGS. 1–4.

Figure 8:
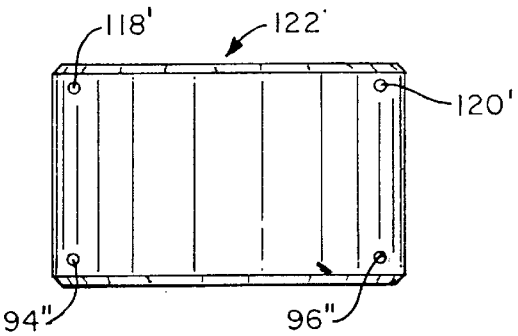
FIG. 8 is an elevation view of the bit retainer element of the embodiment of FIGS. 7.
Figure 7:
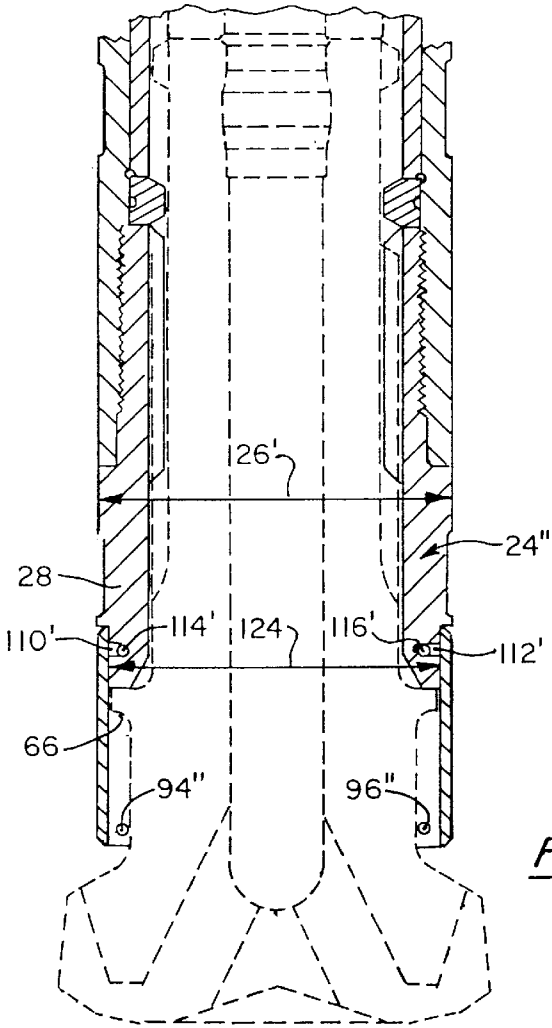
FIG. 7 is an enlarged view, partly in section, of the lower end portion of the hammer-percussion bit assembly according to a third embodiment of the invention.

FIGS. 7 and 8 illustrate a third embodiment of the invention, which is similar to FIGS. 1–4 in regard to the structure and function of the pins 94",96" in relation to the retainer and bit head for retaining the bit head, and similar to the embodiment of FIGS. 5 and 6 in that the retainer is foreshortened and supported with pins 118',120' only at the lower exterior of the chuck, but with the further advantage in that the retainer 122 has the same outside diameter as the chuck 24". This can become a very important feature when the end user wants to run a smaller bit on a particular drill. As the bit head becomes smaller, the clearance between the size of the hole and the retainer is reduced. This increases the speed of the air and cuttings passing the retainer and consequently wears the retainer very rapidly. By reducing the outside diameter of the retainer to the same size as the chuck, the wear is reduced, life of the retainer is extended, and smaller bits can be run than with a retainer that is larger than the chuck.

As is evident in FIGS. 7 and 8, in this third embodiment, the lowermost portion 28' of the chuck has a reduced outside diameter 124 relative to the maximum outside diameter 26' of the chuck (which is typically the same as the maximum outside diameter of the housing 14).

The difference between the reduced and maximum diameter portions of the chuck, is preferably slightly greater than the wall thickness of the retainer 122. The grooves 110',112' in the lower portion of the chuck are provided in this region of reduced diameter. In all other material respects, the embodiments of FIGS. 7 and 8 are similar to that of FIGS. 5 and 6.

The assembly procedure for the second and third embodiments shown in FIGS. 5–8, is similar to that of the first embodiment, in that the retainer, chuck, housing and bit are all assembled before the final step of inserting the pins 94",96" through the lower set of access openings, i.e., below the bit shoulder 66.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A percussion bit assembly for connection to a drill string for earth boring operations comprising:

a substantially tubular housing having a lower end portion defining an opening;

a substantially tubular chuck member having upper and lower portions and upper and lower ends, the upper portion of the chuck member being mountable to the lower end portion of the housing;

a percussion bit having a shank and a head, wherein at least a part of the shank is disposed within the chuck member and the head is disposed below the lower end of the chuck member, the shank including a radially extending shoulder having an outside diameter;

a substantially tubular bit retainer supported by the chuck member and having upper and lower ends and interior and exterior surfaces, said interior surface disposed around the shoulder of the bit and around the lower portion of the chuck member, and with the lower end of the interior surface being spaced from the bit below said shoulder; and means insertable through at least two locations at the exterior surface of the lower end of the retainer into said space between the retainer and the bit, said means when inserted thereby defining opposed ledges situated between the retainer and the bit shank, whereby in the event of breakage of the bit shank above the bit shoulder, the shoulder is retained between the lower end of the chuck member and the ledges.

2. The percussion bit assembly of claim 1, wherein a first of said means is insertable between two holes in the retainer separated by an angle of less than 90°, and a second of said means is insertable between two other holes in the retainer separated by an angle of less than 90°.

3. The percussion bit assembly of claim 1, wherein said means include at least two straight, rigid rods.

4. The percussion bit assembly of claim 1, wherein the bit retainer includes a first pair of holes which register in a first straight line and a second pair of holes which register in a second straight line which is parallel to the first straight line; and said means include a respective two straight, rigid rods, each spanning one pair of holes.

5. The percussion bit assembly of claim 4, wherein the first pair of holes are separated by an angle of about 50°–70° and the second pair of holes are separated by an angle of about 50°–70°.

6. The percussion bit assembly of claim 1, wherein the bit retainer includes an upper lip that extends radially inward; and the upper lip of the retainer is clamped between lower end of the housing and a shoulder on the chuck member.

7. The percussion bit assembly of claim 1 wherein the lower portion of the chuck member has an exterior surface which confronts the interior surface of the upper end of the retainer, above the bit shoulder, said exterior surface having opposed groove profiles; and means are insertable through the exterior surface of the upper end of the retainer for engaging the said groove profiles and supporting the retainer from the chuck member.

8. The percussion bit assembly of claim 7, wherein the groove profiles in the retainer upper end are formed by at least two distinct grooves on said exterior surface of the chuck member.

9. The percussion bit assembly of claim 7, wherein said means insertable through the upper end of the retainer, include at least two straight, rigid rods.

10. The percussion bit assembly of claim 7, wherein the upper end of the bit retainer includes a first pair of access holes which register in a first straight line and a second pair of access holes which register in a second straight line which is parallel to the first straight line; and said means include a respective two straight, rigid rods, each spanning one pair of access holes.

11. The percussion bit assembly of claim 7, wherein the chuck member has a maximum outer diameter and said lower portion of the chuck member has an outer diameter that is recessed relative to the maximum outer diameter of the chuck member; and said bit retainer is supported at the recessed lower portion of the chuck and the exterior surface of the retainer member has an outer diameter that is no larger than the maximum diameter of the chuck member.

12. A bit retainer for attachment to a percussion bit assembly, comprising a substantially tubular member defining a bore having a lower region of substantially uniform internal diameter, and two pairs of holes penetrating the tubular member in said lower region, for receiving a respective two bit retaining pins.

13. The bit retainer of claim 12, wherein the tubular member has an upper end including an interiorly projecting lip.

14. The bit retainer of claim 12, wherein the bore is of substantially uniform internal diameter through the entire tubular member, and another two pairs of holes penetrate the tubular member at an upper region of the bore.

15. The retainer of claim 12, wherein the holes are oriented transversely to the axis of the bore.

16. The retainer of claim 14, wherein all the holes are oriented transversely to the axis of the bore.

17. A method for securing a bit retainer to a percussion bit assembly, comprising securing an externally shouldered bit for longitudinal movement within a tubular housing, securing a substantially tubular retainer member in fixed relation to the housing so that the retainer member surrounds and extends below the bit shoulder, and inserting pin means through the exterior surface into the interior of the retainer at locations below the bit shoulder.

* * * * *